US006530163B2

(12) United States Patent
Skapyak et al.

(10) Patent No.: US 6,530,163 B2
(45) **Date of Patent: *Mar. 11, 2003**

(54) STEMWARE IDENTIFICATION BRACELETS AND METHOD OF USE

(76) Inventors: Kip M. Skapyak, 6121 A Clark Center Ave., Sarasota, FL (US) 54238; Ann DeLanghe, 3300 Poxpoint Rd., Burnsville, MN (US) 55337

( * ) Notice: Subject to any disclaimer, the term of this patent is extended or adjusted under 35 U.S.C. 154(b) by 0 days.

This patent is subject to a terminal disclaimer.

(21) Appl. No.: 09/963,072

(22) Filed: Sep. 24, 2001

(65) Prior Publication Data

US 2002/0083629 A1 Jul. 4, 2002

Related U.S. Application Data

(62) Division of application No. 09/755,490, filed on Jan. 4, 2001, now Pat. No. 6,293,034.

(51) Int. Cl.[7] ..... G09F 3/00
(52) U.S. Cl. ..... 40/310; 40/324
(58) Field of Search ..... 40/310, 324

(56) References Cited

U.S. PATENT DOCUMENTS

| | | | | |
|---|---|---|---|---|
| D47,490 | S | | 6/1915 | Hunter |
| D80,932 | S | | 4/1930 | Danco |
| 1,971,528 | A | | 8/1934 | Klebanow |
| D106,976 | S | | 11/1937 | Hokerk |
| 2,976,629 | A | | 3/1961 | Brixius et al. |
| D256,899 | S | | 9/1980 | Mazzini |
| D269,863 | S | | 7/1983 | Meyer |
| 4,680,882 | A | | 7/1987 | Watson, Jr. |
| 4,908,244 | A | | 3/1990 | Bullock |
| 5,085,391 | A | * | 2/1992 | Berger et al. ..... 248/311.2 |
| 5,558,236 | A | * | 9/1996 | Williams et al. ..... 211/74 |
| 5,607,077 | A | * | 3/1997 | Torkelson ..... 220/575 |
| D406,213 | S | | 3/1999 | Rausch |
| 5,899,515 | A | * | 5/1999 | Burns ..... 294/159 |
| D414,435 | S | | 9/1999 | Nahon |
| 6,244,554 | B1 | * | 6/2001 | Baker ..... 248/312 |
| 6,293,034 | B1 | * | 9/2001 | Skapyak et al. ..... 40/310 |
| D459,151 | S | * | 6/2002 | Skapyak ..... D7/396.2 |
| 2001/0042729 | A1 | * | 11/2001 | Gale ..... 215/228 |
| 2001/0054817 | A1 | * | 12/2001 | Kelley et al. ..... 283/70 |

* cited by examiner

*Primary Examiner*—J. J. Swann
*Assistant Examiner*—Andrea Chop
(74) *Attorney, Agent, or Firm*—Gene Scott-Patent Law & Venture Group

(57) ABSTRACT

A plurality of stemware rings, are formed of resilient material in a loop having a pair of opposing and abutting ends. The loops are of a size for accepting a stem of a wine or other stemmed glass, and further, for being supported on a base of such a glass. The stemware rings each provide a distinctive ornamentation so as to distinguish the glasses from each other. The method includes distributing the glasses to guests with the rings engaged on the stems of the glasses so that one glass may be distinguished from the next, personalized, fitted to the occasion and other uses.

6 Claims, 2 Drawing Sheets

STEMWARE IDENTIFICATION BRACELETS AND METHOD OF USE

The present invention is a divisional of Ser. No. 09/755,490 filed on Jan. 4, 2001 and now pending issuance as U.S. Pat. No. 6,293,034.

BACKGROUND OF THE INVENTION

1. Field of the Invention

This invention relates generally to methods and means for marking items which may be otherwise indistinguishable in use and more particularly to a method and means for marking stemware glasses such as wine glasses.

2. Description of Related Art

The following art defines the present state of this field:

Hunter, U.S. Pat. No. D47,490 describes an article of manufacture.

Danco, U.S. Pat. No. D80,932 describes a tag for containers.

Hokerk, U.S. Pat. No. D106,976 describes a combined cake of soap and support therefor.

Mazzini, U.S. Pat. No. D256,899 describes a decorative chain segment.

Meyer, U.S. Pat. No. D269,863 describes a segmented heart-shaped pendant or similar article.

Rausch, U.S. Pat. No. D406,213 describes a bottle collar.

Nahon, U.S. Pat. No. D414,435 describes a bracelet thermometer for wine bottle.

Klebanow, U.S. Pat. No. 1,971,528 describes a display device for disposition upon the upper portion of a container comprising in combination a substantially flat sheet cut in the form of the form, a score line dividing the sheet into two leaves, and a flap eccentrically cut from one of the leaves, said flap being smaller in diameter than said leaves and adapted to bend on said score line.

Brixius et al., U.S. Pat. No. 2,976,629 describes an identifying device capable of being removably affixed to the neck of a bottle, comprising: a substantially planar circular plate adapted to receive identifying indicia thereon; engaging means adapted to engage the neck of said bottle to support said plate therefrom said engaging means being arcuate in configuration with an inside diameter mateable with the outside diameter of said plate, means for pivotally affixing said engaging means to said plate at a peripheral point thereon, said engaging means being pivotable form a first position substantially in the plane of said plate to a second position substantially transverse thereto, said affixing means defining a radially inwardly extending resilient leg juxtaposed to one surface of said plate and substantially parallel thereto.

Watson, Jr., U.S. Pat. No. 4,680,882 describes an identification tag for articles and containers, which is characterized by a base tag member having an extended leg for attachment to an article or looping through the handle of a container, the base tag member further provided with spaced indicia areas for identifying the article or the contents of the container and staggered snap openings extending through opposite faces of the base tag member for receiving at least a top cap member and preferably, a top cap member and a bottom cap member, each cap member having multiple snaps for engaging the snap openings and provided with a window which is aligned with selected ones of the indicia areas when the cap members are snapped on opposite faces of the base tag member.

Bullock, U.S. Pat. No. 4,908,244 describes an ornamental device and a kit therefor. In the preferred embodiment, layers of ornamental balls with progressively decreasing diameters are threaded down a shaft and nested together to simulate a Christmas tree. The kit may further include a protective support having pockets for receiving the various balls, base, shaft and decorative pinnacle for the device.

The prior art teaches the use of decorative devices for visual appeal, see Hunter, Danco, Hokerk, etc., and for function, see, for instance, Rausch, Nahon, and Klebanow. Such devices are generally used as identification means. However, the prior art does not teach the use of identification rings such that one stemware glass is clearly distinguishable from the next. The prior art also does not teach the use of rings that have resiliently abutting ends for snapping onto and off of the stems of stemware glasses. The present invention fulfills these needs and provides further related advantages as described in the following summary.

SUMMARY OF THE INVENTION

The present invention teaches certain benefits in construction and use which give rise to the objectives described below.

A plurality of stemware rings, are formed of resilient material in a loop having a pair of opposing and abutting ends. The loops are of a size for accepting a stem of a stemware glass, and further, for being supported on a base of a stemware glass. The stemware rings each provide a distinctive ornamentation so as to distinguish the stemware glasses from each other. The method includes distributing the stemware glasses to guests with the rings engaged with the stems of the glasses so that one glass may be distinguished from the next.

A primary objective of the present invention is to provide an apparatus and method of use of such apparatus that provides advantages not taught by the prior art.

Another objective is to provide such an invention capable of easily distinguishing one stemware glass from the next when in use.

A further objective is to provide a benefit in preventing the spread of disease.

A still further objective is to provide such an invention capable of providing an improved decorative or a theme appearance.

A yet further objective is to provide such an invention that is easy to use, and inexpensive to manufacture.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description. In the following description the term "wine glass" is used predominantly, but such usage is meant to refer to not only wine glasses but also to any glass that has a stem, such as water glasses, Champaign glasses and the like.

Figure 1A:
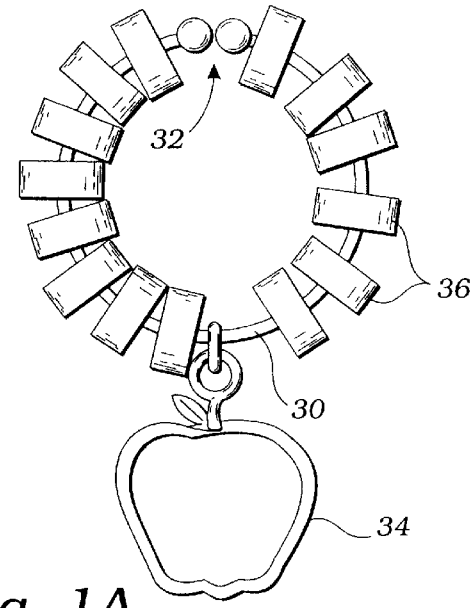
FIG. 1A is a plan view of a preferred embodiment of a stemware ring of the invention.
Figure 1B:
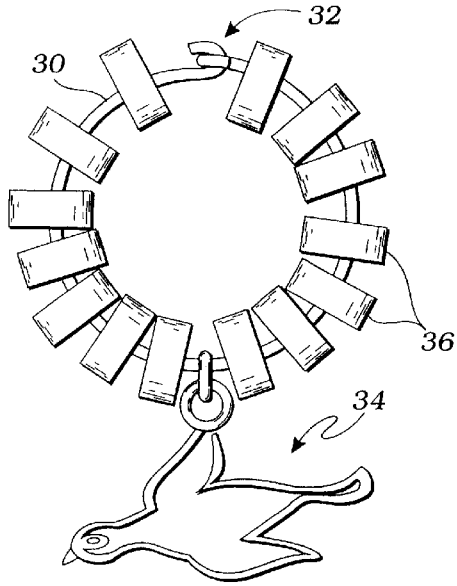
FIG. 1B is a plan view of another preferred embodiment of a stemware ring thereof.

A plurality of stemware rings 30 are each preferably formed of spring steel in a loop, as best seen in FIGS. 1A and 1B. These rings 30 each have a pair of opposing and resiliently abutting ends 32. The rings 30 are of a size for accepting a stem 42 of stemware such as a wine glass 40, as shown in FIG. 3, and further, for being supported on a base 44 of the wine glass 40. The rings 30 are formed so as to assure that the ends 32 are in contact, as shown in FIG. 1A or locked together, as shown in FIG. 1B so that they cannot fall off the wine glasses 40, but may be engaged and disengaged at will as demonstrated in FIG. 2 (see arrows). The stemware rings 30 each provide a distinctive means for ornamenting 34 so as to distinguish the stemware rings 30 from each other, and therefore, in use, to also distinguish the wine glasses 40 from each other. Such distinguishment may be through shape, color, size or any other manner where it is possible to see that one of the rings 30 is clearly different from any one of the other rings 30. This is important as one may not be willing to inadvertently drink from another's glass in the prevention of the spread of disease. Clearly, in the midst of a party, it is not likely that the use of simple number stickers would be in keeping with the mood. On the contrary, it would seem be out of keeping with such events. However, when a decorative element is added to the wine glass, it enhances the party mood and may be selected to be in context with a party theme, such as numerical figures defining a birthday, i.e., 29+, statements such as "Over The Hill," and icon figures well known in defining occasions for graduation, birth, wedding, and so on.

Figure 2:
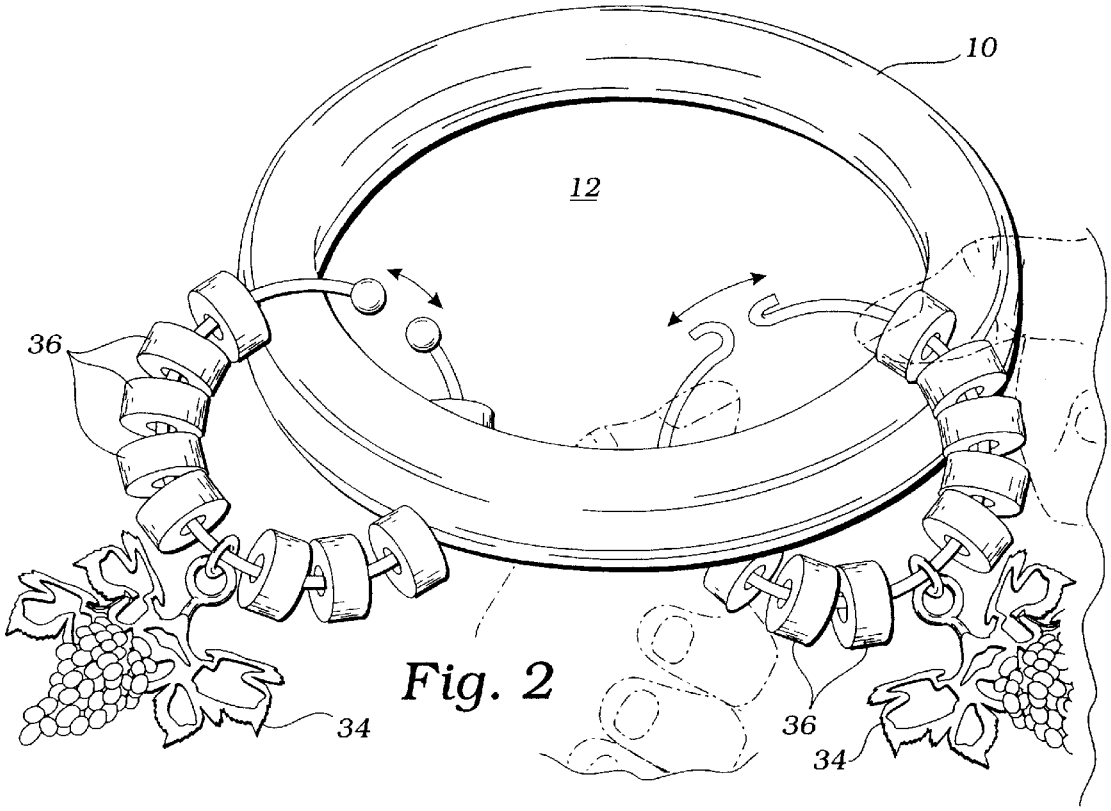
FIG. 2 is a perspective view of a bottle ring thereof, showing the manner of attachment of stemware rings thereto.
Figure 3:
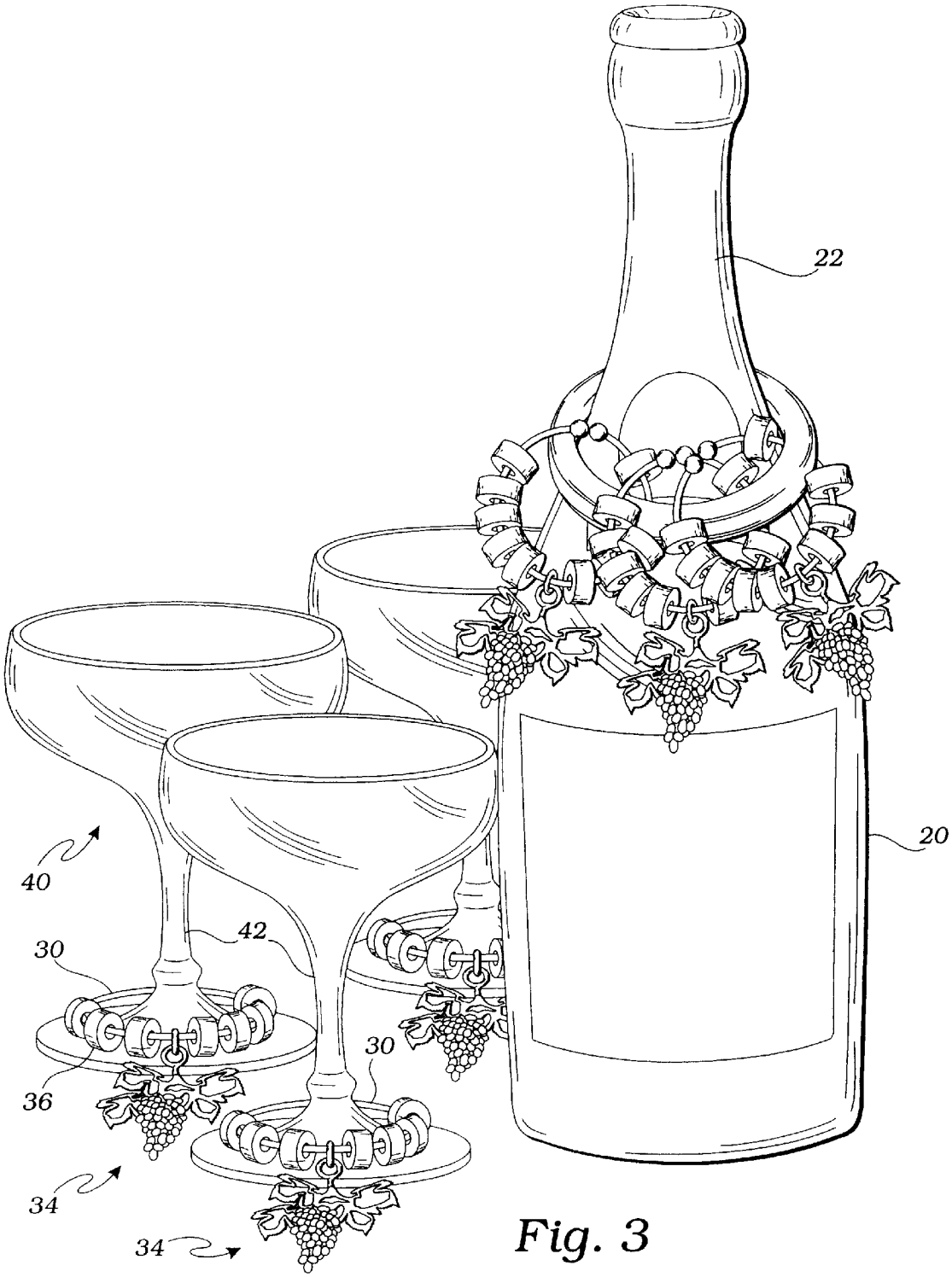
FIG. 3 is perspective view showing the manner of use of the invention.

The ornamenting means 34 is preferably such an icon as shown in FIG. 2, i.e., a bunch of grapes, but also may include at least one, but preferably a plurality of beads 36 which are preferably movable on the ring 30. This is important so that the ornamentation means 34 may be positioned or placed so as to be seen by the user. The opposing and abutting ends 32 of the loops of the stemware rings 30 are preferably formed as mutually engagable hooks, as shown in FIG. 1B or as abutting spheres, as shown in FIG. 1A. In each case, the spring nature of the material of the ring 30 and of its preferred resilient attitude keeps the ends 32 in abutment so as to assure the ring's engagement on the glass stem 42.

Alternately, the present invention is comprised as described above in a combination. This combination comprises a plurality of wine glasses 40 and the identification apparatus as described and shown in FIG. 3. The identification apparatus includes a plurality of the stemware rings 30. Preferably, the stemware rings 30 are themselves an assembly of the spring steel ring and the ornamentation means 34 along with beads 36 for positioning the ornamentation means 34 at a position for being viewed. It should be noticed that the beads 36 provide for easy adjustment of the ornamentation means 34.

The present invention further provides a method of use wherein a user may distinguish one wine glass from another. This method provides a plurality of stemware rings 30 wherein each of the stemware rings is visually distinguishable from each of the other stemware rings 30. The method provides for placing the plurality of stemware rings 30 around the around the stems 42 of the wine glasses 40 to distinguish the wine glasses 40 from each other in use.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An identification apparatus comprising in combination: a plurality of stemware rings and:an equal plurality of stemware glasses, each of the stemware glasses providing a stem and a base; each one of the stemware rings engaged around the stem of one of the stemware glasses, the stemware rings each forming a loop having a pair of opposing, resiliently abutting terminal ends, and a girth smaller than the diameter of the base, each of the stemware rings further providing a distinctive means for ornamenting so as to uniquely distinguish each of the stemware glasses.

2. The apparatus of claim 1 wherein the means for ornamenting on at least one of the stemware rings includes at least one bead, the at least one bead movably engaged on the at least one of the stemware rings.

3. The apparatus of claim 1 wherein the opposing and abutting ends of the loops of the stemware rings are formed as mutually engagable hooks.

4. The apparatus of claim 1 wherein the opposing and abutting ends of the loops of the stemware rings are formed as spheres.

5. A method of distinguishing one stemware glass from another comprising the steps of: forming a plurality of decorative stemware rings having resiliently abutting ends, and placing each one of the stemware rings about the stem of one of a plurality of stemware glasses to distinguish each one of the stemware glasses from each other of the stemware glasses.

6. A method of distinguishing one stemware glass from another comprising the steps of: forming a plurality of decorative stemware rings having hook engagable ends, placing each one of the stemware rings about the stem of one of a plurality of stemware glasses, and engaging the hook ends of the stemware rings to secure the stemware rings on the stemware glasses, to distinguish each one of the stemware glasses from each other of the stemware glasses.

* * * * *